US011783674B2

(12) United States Patent
Dikeou et al.

(10) Patent No.: US 11,783,674 B2
(45) **Date of Patent: *Oct. 10, 2023**

(54) GAME FOR BETTING ON BLACKJACK WITH A SIDE BET

(71) Applicant: CnP2020 LLC, Ferndale, MI (US)

(72) Inventors: Cristi Lynn Dikeou, Fowlerville, MI (US); Pamela Ann Balicki, Ferndale, MI (US)

(73) Assignee: CnP2020 LLC, Ferndale, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/669,936

(22) Filed: Feb. 11, 2022

(65) Prior Publication Data

US 2022/0165131 A1 May 26, 2022

Related U.S. Application Data

(63) Continuation of application No. 17/168,474, filed on Feb. 5, 2021, now Pat. No. 11,282,339.

(60) Provisional application No. 62/970,746, filed on Jun. 8, 2020.

(51) Int. Cl.
*G07F 17/32* (2006.01)

(52) U.S. Cl.
CPC ..... *G07F 17/3262* (2013.01); *G07F 17/3288* (2013.01); *G07F 17/3293* (2013.01)

(58) Field of Classification Search
CPC ..... G07F 17/3248; G07F 17/3258; G07F 17/3293; A63F 1/00; A63F 2001/003; A63F 3/00157
See application file for complete search history.

(56) References Cited

U.S. PATENT DOCUMENTS

| | | | | |
|---|---|---|---|---|
| 5,607,162 | A * | 3/1997 | Boylan | A63F 3/00157 273/274 |
| 5,636,843 | A | 6/1997 | Roberts | |
| 5,984,308 | A | 11/1999 | Herrmann | |
| 6,062,564 | A | 5/2000 | Terminel | |
| 6,158,741 | A * | 12/2000 | Koelling | A63F 3/00157 463/12 |
| 6,394,456 | B1 * | 5/2002 | Long | A63F 1/00 273/292 |
| 10,755,530 | B1 | 8/2020 | Kowalchuk et al. | |
| 11,282,339 | B2 * | 3/2022 | Dikeou | G07F 17/3262 |
| 2003/0222400 | A1 | 12/2003 | Collins et al. | |

(Continued)

*Primary Examiner* — Milap Shah

(74) *Attorney, Agent, or Firm* — Carlson, Gaskey & Olds, P.C.

(57) ABSTRACT

An example game for wagering on a card game includes providing cards and a gaming layout that includes a first wager area corresponding to a dealer pair wager, a second wager area corresponding a player pair wager, and a third wager area corresponding to a player/dealer pair wager. A player is the winner of a first wager if any of the following are met: a first wager is accepted on the first wager area and a first dealer card (dealt to the player) and a second dealer card (dealt to a dealer) have the same rank; the first wager is accepted on the second wager area and first and second player cards have the same rank; the first wager is accepted on the third wager area and one of the first and second player cards has the same rank as one of the first and second dealer cards.

9 Claims, 1 Drawing Sheet

(56) References Cited

U.S. PATENT DOCUMENTS

| | | | | |
|---|---|---|---|---|
| 2004/0090008 | A1* | 5/2004 | Caldwell | A63F 3/00157 273/303 |
| 2005/0012268 | A1* | 1/2005 | Moshal | G07F 17/32 273/139 |
| 2005/0035547 | A1* | 2/2005 | Henry | A63F 3/00157 273/274 |
| 2005/0269781 | A1 | 12/2005 | Sorge | |
| 2005/0285342 | A1 | 12/2005 | Terminel | |
| 2006/0014577 | A1 | 1/2006 | Snow | |
| 2006/0192338 | A1 | 8/2006 | Chen et al. | |
| 2007/0040333 | A1* | 2/2007 | Au-Yeung | A63F 1/06 273/303 |
| 2007/0052175 | A1* | 3/2007 | McGurk | A63F 3/00157 273/292 |
| 2007/0170652 | A1* | 7/2007 | Perrie | A63F 3/00157 273/292 |
| 2007/0194530 | A1 | 8/2007 | Newman et al. | |
| 2007/0252333 | A1* | 11/2007 | Hernandez | A63F 3/00157 273/292 |
| 2009/0200741 | A1* | 8/2009 | Klempel | G07F 17/32 273/292 |
| 2010/0295247 | A1* | 11/2010 | LaDuca | A63F 1/00 463/12 |
| 2011/0045887 | A1 | 2/2011 | Munakata | |
| 2012/0169010 | A1 | 7/2012 | Blaine et al. | |
| 2019/0099661 | A1 | 4/2019 | LaDuca et al. | |

* cited by examiner

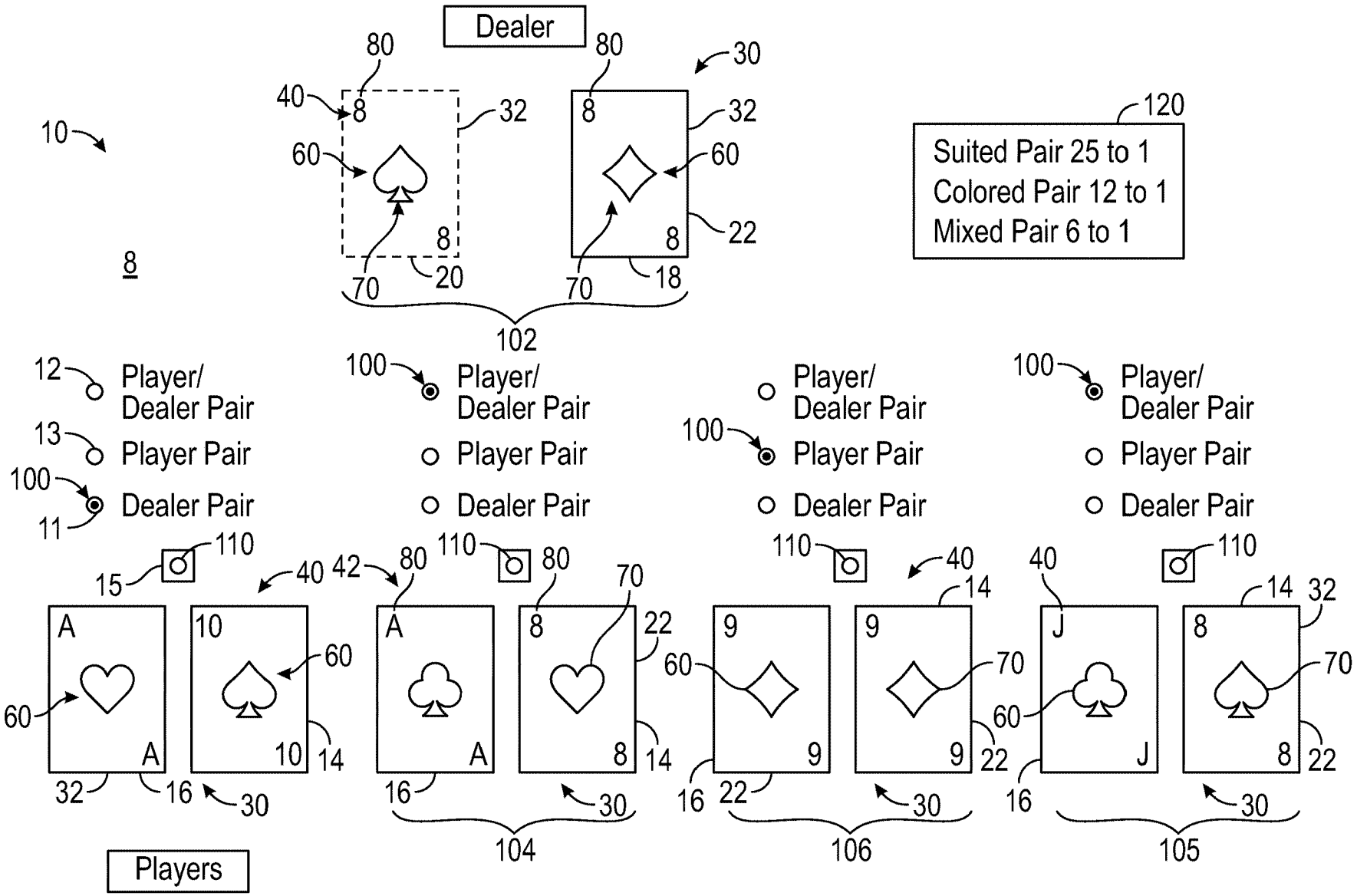
8

GAME FOR BETTING ON BLACKJACK WITH A SIDE BET

CROSS-REFERENCE TO RELATED APPLICATIONS

This application is a continuation of U.S. application Ser. No. 17/168,474, filed Feb. 5, 2021, which claims the benefit of U.S. Provisional Application No. 62/970,746, filed on Jun. 8, 2020, the disclosures of each of which are incorporated by reference herein in their entirety.

BACKGROUND

This disclosure relates to a game for wagering on Blackjack also known as Twenty-One. The game of Blackjack typically involves cards dealt by a dealer to one or more players. Each of the cards has a suit, such as clubs, hearts, diamonds or spades; a rank, such as cards increasing in rank from two to ten, a Jack, a Queen, a King and an Ace; and an assigned numerical value from one to eleven, such as cards from two to ten having their face value, the Ace having an assigned numerical value of either one or eleven, and the Jack, Queen, and King having an assigned numerical value of ten. As known, the dealer deals at least two cards to the player and to themself. The dealer keeps one of their cards hidden from view from the player. The player may decide to take no cards or to take additional cards prior to the dealer revealing their hidden card.

As between the dealer and the player, the winner is determined by adding the assigned numerical values of the cards held by the player to arrive at a player combined numerical value and adding the assigned numerical value of the cards held by the dealer to arrive at a dealer combined numerical value. The winner is the closest to and including twenty-one but not exceeding twenty-one. Generally, if the dealer and the player have the same combined numerical value, there is tie or "push" where there is no winner. The rules of the game also provide a natural twenty-one, an Ace along with a ten, Jack, Queen, or King wins even if the dealer has cards amounting to twenty-one unless the dealer also has a natural twenty-one, which results in a push if the player has not asked for even money. If the player has asked for even money, then she is paid one-to-one for her wager.

At a casino, the player places a wager on whether she will win. If the player wins, the casino will pay out the wager in the same amount of the bet. The casino may pay out more if the player wins by receiving an Ace and one of a ten, a Jack, a Queen, or a King, otherwise known as a "natural 21". Though the game of Blackjack is very popular, there is a need for a system of wagering that rewards the player for taking greater risks. Such a system can make the game of Blackjack more exciting for the player while simultaneously rendering the game more profitable to the casino.

SUMMARY

A game for wagering on a card game, comprising the steps of providing a set of cards, each card having an assigned numerical value from one to eleven, a suit, a color and a rank. The dealer accepts two different wagers: a first wager and a second wager. The dealer then deals a first player card to a player and a first dealer card to the dealer from the set of cards. The dealer also deals a second player card to the player and a second dealer card to the dealer, the second dealer card hidden from view from the player.

The winner of the first wager is determined based on whether a pair has been dealt. The pair comprises at least two of the first player card, the second player card, the first dealer card and the second dealer card, each card of the pair having the same rank. Determining a winner of the second wager is based on a comparison of a player combined numerical value of at least the first player card added to the second player card player, the player combined numerical value not exceeding twenty-one, and a dealer combined numerical value of at least the first dealer card added to the second dealer card, the dealer combined value not exceeding twenty-one.

The various features and advantages of this disclosure will become apparent to those skilled in the art from the following detailed description. The drawings that accompany the detailed description can be briefly described as follows.

BRIEF DESCRIPTION OF THE DRAWINGS

The various features and advantages of this disclosure will become apparent to those skilled in the art from the following detailed description. The drawings that accompany the detailed description can be briefly described as follows.

FIG. 1 illustrates a gaming table with a card game for the inventive system of wagering.

DETAILED DESCRIPTION

This disclosure relates to a game for wagering on a card game, commonly known as Blackjack or Twenty One. The game of Blackjack commonly involves cards dealt by a dealer to one or more players. Each of the cards has a suit, such as clubs, hearts, diamonds or spades; a rank, such as cards increasing in rank from two to ten, a Jack, a Queen, a King and an Ace; and an assigned numerical value from one to eleven, such as cards from two to ten having their face value, the Ace having an assigned numerical value of either one or eleven, and the Jack, Queen, and King having an assigned numerical value of ten. As known, the dealer deals at least two cards to the player and to themself. The dealer keeps one of their cards hidden from view from the player. The player may decide to take no cards or to take additional cards prior to the dealer revealing their hidden card.

As between the dealer and the player, the winner is determined by adding the assigned numerical values of the cards held by the player to arrive at a player combined numerical value and adding the assigned numerical value of the cards held by the dealer to arrive at a dealer combined numerical value. The winner is the closest to and including twenty-one but not exceeding twenty-one. Generally, if the dealer and the player have the same combined numerical value, there is tie or "push" where there is no winner. The rules of the game also provide a natural twenty-one, an Ace along with a ten, Jack, Queen, or King wins even if the dealer has cards amounting to twenty-one unless the dealer also has a natural twenty-one, which results in a push if the player has not asked for even money. If the player has asked for even money, then she is paid one-to-one for her wager.

At a casino or other gaming establishment, an online venue for example, the player places a wager on whether she will win. If the player wins, the casino will pay out the wager in the same amount of the bet. The casino may pay out more if the player wins by receiving an Ace and one of a ten, a Jack, a Queen, or a King. The inventive card game is illustrated by FIG. 1. As shown, FIG. 1 shows card game 10 on gaming table 8. Card game 10 involves one set of cards 30 commonly used in Blackjack, such as at least one standard deck of fifty-two cards or multiple decks, say six decks, which are used for the odds calculations shown below. As known, each set of cards 30 involves cards 32 having assigned numerical value 40 from one to eleven (the Ace 42 counting as either one or eleven, cards having two to ten having their face value, and the Jack, Queen, and King counting as ten), suit 60 (here, clubs, spades, hearts and diamonds), color 70 (clubs and spades are black while hearts and diamonds are red), and rank 80 from increasing order from two through ten, Jack, Queen, King to Ace.

At the start of the game, a player (not shown) may place two different wagers: first wager 100 based on a particular instance of a pair being dealt, i.e. two cards of the same rank 80, and second wager 110 based on winning the Blackjack game (closest to twenty-one). As shown on FIG. 1, each player may place first wager 100, e.g. a chip, on a spot on gaming table 8, indicating they are wagering on the particular instance of a pair being dealt, such as spot for a dealer pair wager 11, spot for a player/dealer pair wager 12 and/or spot for a player pair wager 13. Second wager 110 may be placed on its own spot 15, indicating the player wishes to bet on winning the Blackjack game. The wagers are accepted, though the entity (e.g. dealer, casino or other gambling institution) may choose to limit the amount of the wager accepted. The dealer then deals cards to the players and themself.

The dealer first deals first player card 14 to a player or players and first dealer card 18 to a dealer (also not shown) from set of cards 30. At this point, it may be determined whether any players have won the first wager 100 as described in detail below by way of example, such as by checking to see if there is a chip on the player/dealer pair spot 12. Following this determination, the dealer deals a second player card 16 to the player or players and second dealer card 20 to the dealer. The second dealer card 20 may be hidden from view from the player as illustrated by dashed lines. Following the dealing of the second card to the players, it may also be determined whether there are winners of the first wager 100 as described in detail below by way of example, such as by checking to see if there is a chip on the player pair spot 13.

Determining a winner of first wager 100 based on whether a pair has been dealt may be determined by examining at least two of the first player card, the second player card, the first dealer card and the second dealer card, each card of a pair having the same rank. Whether the player wins first wager 100 may depend on the dealer achieving a pair (dealer pair 102), the player achieving a pair (player pair 106) or the dealer achieving a pair with the player (dealer/player pair 104, 105). For a game, rules may be established that limit the instances of the achievement of the pair to reduce the odds or chances of having to pay the first wager. For example, the player may be required to achieve a player pair in his first two cards to win first wager 100 as shown by player pair 106. Likewise, the dealer pair 102 may be limited to the first two cards dealt to the dealer as shown. Also, the player may win the bet on the player/dealer pair 104, 105 only based on first player card 14 dealt to the dealer and first dealer card 18 dealt to the player.

By way of example only, a winner of first wager 100 for a dealer/player pair (104, 105) may be determined and/or paid out after a card has been dealt to the dealer and to each player since both the dealer and at least one player will have a card to determine whether the pair is formed. A winner of first wager 100 of a player pair may also be determined and/or paid out after two cards are dealt to a player if those cards form a pair. A winner of first wager 100 of a dealer pair can likewise be determined and/or paid out after the dealer reveals their second card. And, as known, the winner of the second wager 110 can be determined and/or paid out upon the revealing of a blackjack.

By way of illustration, as shown in FIG. 1, the dealer has dealt two cards to themself and to the players. Dealer has dealt themself a mixed pair, two cards of the same rank having different colors, here an eight of spades (black color) and an eight of diamonds (red color). Additionally, the dealer has dealt player/dealer pair 104 comprising an Ace of clubs and an eight of hearts (red color). Player/dealer pair 104 forms a colored pair by having their eight of hearts have the same color (red) as the eight of diamonds (also red) in the dealer's hand. Dealer has also dealt player/dealer pair 105 comprising a Jack of clubs and an eight of spades (black color). The eight of spades (black) forms with the eight of diamonds (red) in the dealer's hand a mixed pair, two cards of the same rank having both different suits and colors. Finally, dealer has dealt player pair 106, comprising two nine of diamonds. This pair forms a suited pair—two cards having the same suit and same rank.

In addition to determining the winner of the first wager, the winner of the second wager may be determined according to the standard rules of Blackjack or Twenty-One based on a comparison of the combined numerical value of the dealer's hand and the combined numerical value of each player's hand. The combined numerical value is the sum of assigned values of each card in either the player's or dealer's hand. Since two or more cards are dealt to each player or dealer in Blackjack, the winner is determined based on a comparison of a player combined numerical value of at least the first player card added to the second player card, the player combined numerical value not exceeding twenty-one, and a dealer combined numerical value of at least the first dealer card added to the second dealer card, the dealer combined numerical value not exceeding twenty-one.

The dealer, casino or other gambling entity may award the winner of the first wager an enhanced payout larger than what the player would receive if she had merely won the second wager. For example, the payout could be made for the first wager based on an odds of a particular pair occurring. The payouts are displayed on gaming table 8 as payouts 120. The payouts for a suited pair, two cards having the same rank and suit, could be 25 to 1 requiring a payout of 25 times the amount of the first wager. The payouts for a colored pair, two cards having the same rank and same color (not having the same suit), could be 12 to 1 requiring a payout of 12 times the amount of the first wager. Finally, the payouts for a mixed pair, two cards of the same rank having different colors, could be 6 to 1 requiring a payout of 6 times the amount of the first wager.

The formula for calculating the odds of the various pairs is as follows. There are 312 cards in 6 decks of 52 cards. If one card has been played, for example, a Queen of Hearts, there are 311 cards remaining. The odds of the second card creating a suited pair is calculated by: total remaining cards of the same rank, same suit (Queen of Hearts) divided by total cards remaining (5/311=0.0161). The odds of the second card creating a colored pair is calculated by: total remaining cards of the same rank, same color, not suited (Queen of Diamonds) divided by total cards remaining (6/311=0.0193). The odds of the second card creating a mixed pair is calculated by: total remaining cards of the same rank, opposite color (Queen of Spades & Clubs) divided by total cards remaining (12/311=0.0386). The odds of the second card not creating a pair is calculated by: total remaining cards of a different rank (all cards that are not Queens) divided by total cards remaining (288/311=0.9260). The odds are consistent for a 6-deck shoe. They can be altered only by adding cards to or subtracting cards from the shoe. The payouts for each pair can be adjusted and will change the Rate of Return to the player and the corresponding House Edge. The House Edge on a 6-Deck shoe with payouts of 25 to 1 for a suited pair, 12 to 1 for a colored pair, and 6 to 1 for a mixed pair is 6.11%.

| 6-Deck | Payout | Odds of Hitting | Rate of Return |
|---|---|---|---|
| Suited Pair | 25 | 1.61% | 40.19% |
| Colored Pair | 12 | 1.93% | 23.15% |
| Mixed Pair | 6 | 3.86% | 23.15% |
| No Pair | −1 | 92.60% | −92.60% |
| TOTAL | | 100.00% | −6.11% |

House Edge = 6.11%

*The Odds of Hitting are consistent for a 6-deck shoe regardless of Payout.

*Changing the Payouts will change the Rate of Return, and in turn, the House Edge.

*These statistics are the same for each of the 3 Pair It Up pairs- Player-Dealer, Player, & Dealer.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A game for wagering on a card game, comprising the steps of:

providing a set of cards, each card having an assigned numerical value from one to eleven, a suit, a color and a rank;

providing a gaming layout including a plurality of discrete wager areas, including a first wager area corresponding to a wager on a dealer pair, a second wager area corresponding a wager on a player pair, and a third wager area corresponding to a wager on a player/dealer pair, and a fourth wager area;

accepting a first wager and a second wager, the first wager being accepted on one of the first wager area, second wager area, and third wager area, and the second wager being accepted on the fourth wager area, wherein the first wager area, second wager area, third wager area, and fourth wager area are different from each other and correspond to different areas of the gaming layout;

dealing a first player card to a player and a first dealer card to a dealer from the set of cards;

dealing a second player card to the player and a second dealer card to the dealer, the second dealer card hidden from view from the player;

determining a winner of the first wager based on whether a pair having the same rank has been dealt, wherein the player is the winner of the first wager if any of the following criteria are met:

the first wager is accepted on the first wager area and the first and second dealer cards have the same rank;

the first wager is accepted on the second wager area and first and second player cards have the same rank;

the first wager is accepted on the third wager area and one of the first and second player cards has the same rank as one of the first and second dealer cards; and determining a winner of the second wager based on a comparison of a player combined numerical value of at least the first player card added to the second player card, the player combined numerical value not exceeding twenty-one, and a dealer combined numerical value of at least the first dealer card added to the second dealer card, the dealer combined numerical value not exceeding twenty-one.

2. The game as recited in claim 1, wherein the first wager is accepted on the third wager area and wherein the pair comprises the first dealer card and the first player card.

3. The game as recited in claim 1, wherein the first wager is accepted on the second wager area and wherein the pair comprises the first player card and the second player card.

4. The game as recited in claim 1, wherein the first wager is accepted on the second wager area and wherein the pair comprises the first dealer card and the second dealer card.

5. The game as recited in claim 1, wherein the winner of the first wager is determined prior to the winner of the second wager.

6. The game as recited in claim 1, wherein the winner of the first wager is determined after the winner of the second wager.

7. The game as recited in claim 1, wherein a payout is made for the first wager based on an odds of the pair occurring.

8. The game as recited in claim 7, wherein the payout is higher for the pair having a common suit than for a pair having a common color but no common suit.

9. The game as recited in claim 7, wherein the payout is higher for the pair having a common color than for a pair having no common color.

* * * * *